US008152468B2

(12) United States Patent
Propheter-Hinckley et al.

(10) Patent No.: US 8,152,468 B2
(45) Date of Patent: Apr. 10, 2012

(54) DIVOTED AIRFOIL BAFFLE HAVING AIMED COOLING HOLES

(75) Inventors: Tracy A. Propheter-Hinckley, Manchester, CT (US); Amanda Jean Learned, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 482 days.

(21) Appl. No.: 12/403,976

(22) Filed: Mar. 13, 2009

(65) Prior Publication Data

US 2010/0232946 A1 Sep. 16, 2010

(51) Int. Cl.
*F01D 5/18* (2006.01)

(52) U.S. Cl. ..... 416/96 A

(58) Field of Classification Search ..... 416/97 R, 416/96 A, 224, 232; 415/115
See application file for complete search history.

(56) References Cited

U.S. PATENT DOCUMENTS

| | | | | |
|---|---|---|---|---|
| 2,873,944 | A | 2/1959 | Wiese et al. | |
| 2,994,124 | A | 8/1961 | Denny et al. | |
| 3,806,275 | A * | 4/1974 | Aspinwall | 416/97 R |
| 4,153,386 | A | 5/1979 | Leogrande et al. | |
| 4,396,349 | A | 8/1983 | Hueber | |
| 4,519,745 | A | 5/1985 | Rosman et al. | |
| 4,859,141 | A | 8/1989 | Maisch et al. | |
| 5,073,083 | A | 12/1991 | Guyon | |
| 5,193,975 | A | 3/1993 | Bird et al. | |
| 5,383,766 | A | 1/1995 | Przirembel et al. | |
| 5,405,242 | A | 4/1995 | Auxier et al. | |
| 5,577,889 | A | 11/1996 | Terazaki et al. | |
| 5,591,002 | A | 1/1997 | Cunha et al. | |
| 6,210,112 | B1 | 4/2001 | Tabbita et al. | |
| 6,439,847 | B2 | 8/2002 | Taeck | |
| 6,467,167 | B2 | 10/2002 | Dodd | |
| 6,554,563 | B2 | 4/2003 | Noe et al. | |
| 6,659,714 | B1 | 12/2003 | Tiemann | |
| 6,955,522 | B2 | 10/2005 | Cunha et al. | |
| 7,118,326 | B2 | 10/2006 | Liang | |
| 7,137,783 | B2 * | 11/2006 | Pabion et al. | 416/96 A |
| 7,497,655 | B1 * | 3/2009 | Liang | 415/1 |
| 2001/0021342 | A1 * | 9/2001 | Taeck | 415/12 |
| 2004/0009066 | A1 * | 1/2004 | Soechting et al. | 416/96 R |
| 2007/0243065 | A1 * | 10/2007 | Devore et al. | 416/97 R |
| 2010/0054932 | A1 * | 3/2010 | Schiavo | 415/200 |
| 2010/0166564 | A1 * | 7/2010 | Benjamin et al. | 416/223 R |

FOREIGN PATENT DOCUMENTS

JP 2001304551 A * 10/2001

* cited by examiner

*Primary Examiner* — Matthew Landau
*Assistant Examiner* — Joseph C Nicely
(74) *Attorney, Agent, or Firm* — Kinney & Lange, P.A.

(57) ABSTRACT

A baffle insert for an internally cooled airfoil comprises a liner, a divoted segment and a plurality of cooling holes. The liner has a continuous perimeter formed to shape a hollow body having a first end and a second end. The divoted segment of the hollow body is positioned between the first end and the second end. The plurality of cooling holes is positioned on the divoted segment to aim cooling air exiting the baffle insert at a common location.

20 Claims, 4 Drawing Sheets

DIVOTED AIRFOIL BAFFLE HAVING AIMED COOLING HOLES

BACKGROUND

The present invention is related to cooling of airfoils for gas turbine engines and, more particularly, to baffle inserts for impingement cooling of airfoil vanes. Gas turbine engines operate by passing a volume of high energy gases through a series of compressors and turbines in order to produce rotational shaft power. The shaft power is used to turn a turbine for driving a compressor to provide air to a combustion process to generate the high energy gases. Additionally, the shaft power is used to power a secondary turbine to, for example, drive a generator for producing electricity, or to produce high momentum gases for producing thrust. Each compressor and turbine comprises a plurality of stages of vanes and blades, each having an airfoil, with the rotating blades pushing air past the stationary vanes. In general, stators redirect the trajectory of the air coming off the rotors for flow into the next stage. In the compressor, stators convert kinetic energy of moving air into pressure, while, in the turbine, stators accelerate pressurized air to extract kinetic energy.

In order to produce gases having sufficient energy to drive both the compressor and the secondary turbine, it is necessary to compress the air to elevated temperatures and to combust the air, which again increases the temperature. Thus, the vanes and blades are subjected to extremely high temperatures, often times exceeding the melting point of the alloys used to make the airfoils. In particular, the leading edge of an airfoil, which impinges most directly with the heated gases, is heated to the highest temperature along the airfoil. The airfoils are maintained at temperatures below their melting point by, among other things, cooling the airfoils with a supply of relatively cooler air that is typically siphoned from a compressor. The cooling air is directed into the blade or vane to provide cooling of the airfoil through various modes including impingement cooling. Specifically, the cooling air is passed into an interior of the airfoil to remove heat from the alloy. The cooling air is subsequently discharged through cooling holes in the airfoil to pass over the outer surface of the airfoil to prevent the hot gases from contacting the vane or blade. In other configurations, the cooling air is typically directed into a baffle disposed within a vane interior and having a plurality cooling holes. Cooling air from the cooling holes impinges on an interior surface of the vane before exiting the vane at a trailing edge discharge slot.

Due to the extremely thin nature of the baffle, it is difficult to control the cooling air as it leaves the baffle. Various baffle designs have been developed to better distribute cooling air along the interior surfaces of the vane. Many previous baffle designs require extensive fabricating, shaping and assembly steps, which increase manufacturing time and expense. There is, therefore, a need for a simpler baffle design that is easy to produce and cost effective.

SUMMARY

The present invention is directed to a baffle insert for an internally cooled airfoil. The baffle insert comprises a liner, a divoted segment and a plurality of cooling holes. The liner has a continuous perimeter formed to shape of a hollow body having a first end and a second end. The divoted segment of the hollow body is positioned between the first end and the second end. The plurality of cooling holes is positioned on the divoted segment to aim cooling air exiting the baffle insert at a common location.

DETAILED DESCRIPTION

Figure 1:
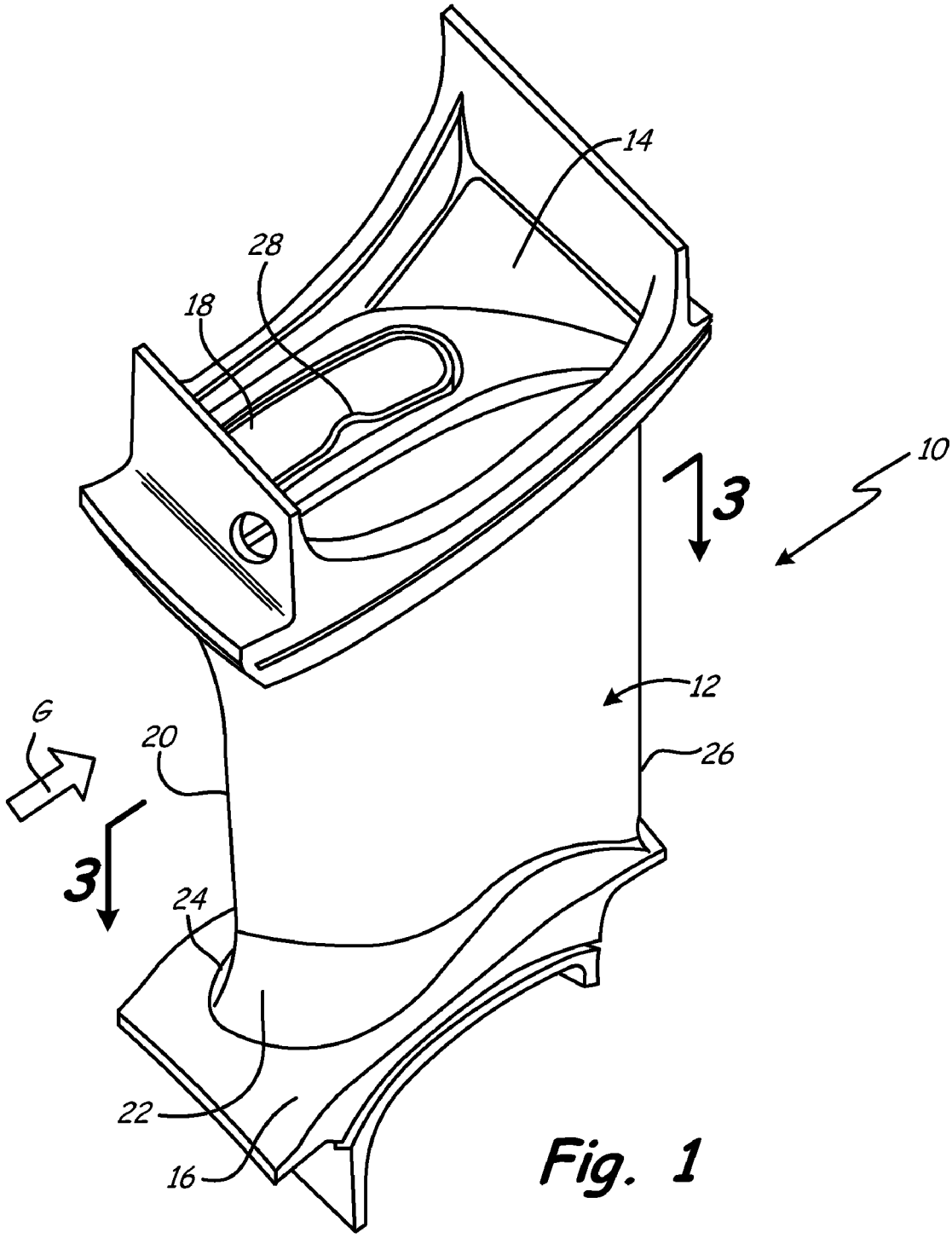
FIG. 1 is a perspective view of a stationary turbine vane showing an airfoil baffle having divots of the present invention.

FIG. 1 shows a perspective view of stationary turbine vane 10 having airfoil 12, outer diameter vane shroud 14, inner diameter vane shroud 16 and baffle 18. Airfoil 12 includes leading edge 20, pressure side 22, suction side 24 and trailing edge 26. Baffle 18 includes divot 28.

Turbine vane 10 is a stationary vane that receives high energy gas G in a turbine section of a gas turbine engine. In other embodiments, vane 10 is used in a compressor section of a gas turbine engine. The outer diameter end of airfoil 12 mates with shroud 14 and the inner diameter end of airfoil 12 mates with shroud 16. Shrouds 14 and 16 are connected to adjacent shrouds within the gas turbine engine to form structures between which airfoil 12 is supported. Outer diameter shrouds 14 are connected using, for example, threaded fasteners and suspended from an outer diameter engine case. Inner diameter shrouds 16 are similarly connected and supported by inner diameter support struts. Turbine vanes 10 operate to increase the efficiency of the gas turbine engine in which they are installed.

Vane shroud 14 and vane shroud 16 increase the efficiency of the gas turbine engine by forming outer and inner boundaries for the flow of gas G through the gas turbine engine. Vane shrouds 14 and 16 prevent escape of gas G from the gas turbine engine such that more air is available for performing work. The shape of vane 10 also increases the efficiency of the gas turbine engine. Vane 10 generally functions to redirect the trajectory of gas G coming from a combustor section or a blade of an upstream turbine stage to a blade of a downstream turbine stage. Pressure side 22 and suction side 24 redirect the flow of gas G received at leading edge 20 such that, after passing by trailing edge 26, the incidence of gas G on the subsequent rotor blade stage is optimized. As such, more work can be extracted from the interaction of gas G with downstream blades.

The efficiency of the gas turbine engine is also improved by increasing the temperature to which vane 10 can be subjected. In one embodiment, vane 10 comprises a high pressure turbine vane that is positioned downstream of a combustor section of a gas turbine engine to receive hot combustion gas. Airfoil 12 is, therefore, subjected to a concentrated, steady stream of combustion gas G during operation of the gas turbine engine. The extremely elevated temperatures of combustion gas G often exceed the melting point of the material forming vane 10. Airfoil 12 is therefore cooled using cooling air provided by, for example, relatively cooler air bled from a compressor section within the gas turbine engine. The cooling air is directed into baffle 18 where small cooling holes distribute the cooling air to perform impingement cooling on the interior of airfoil 12. Divot 28 focuses a portion of the cooling air onto hotspots of airfoil 12.

Figure 2:
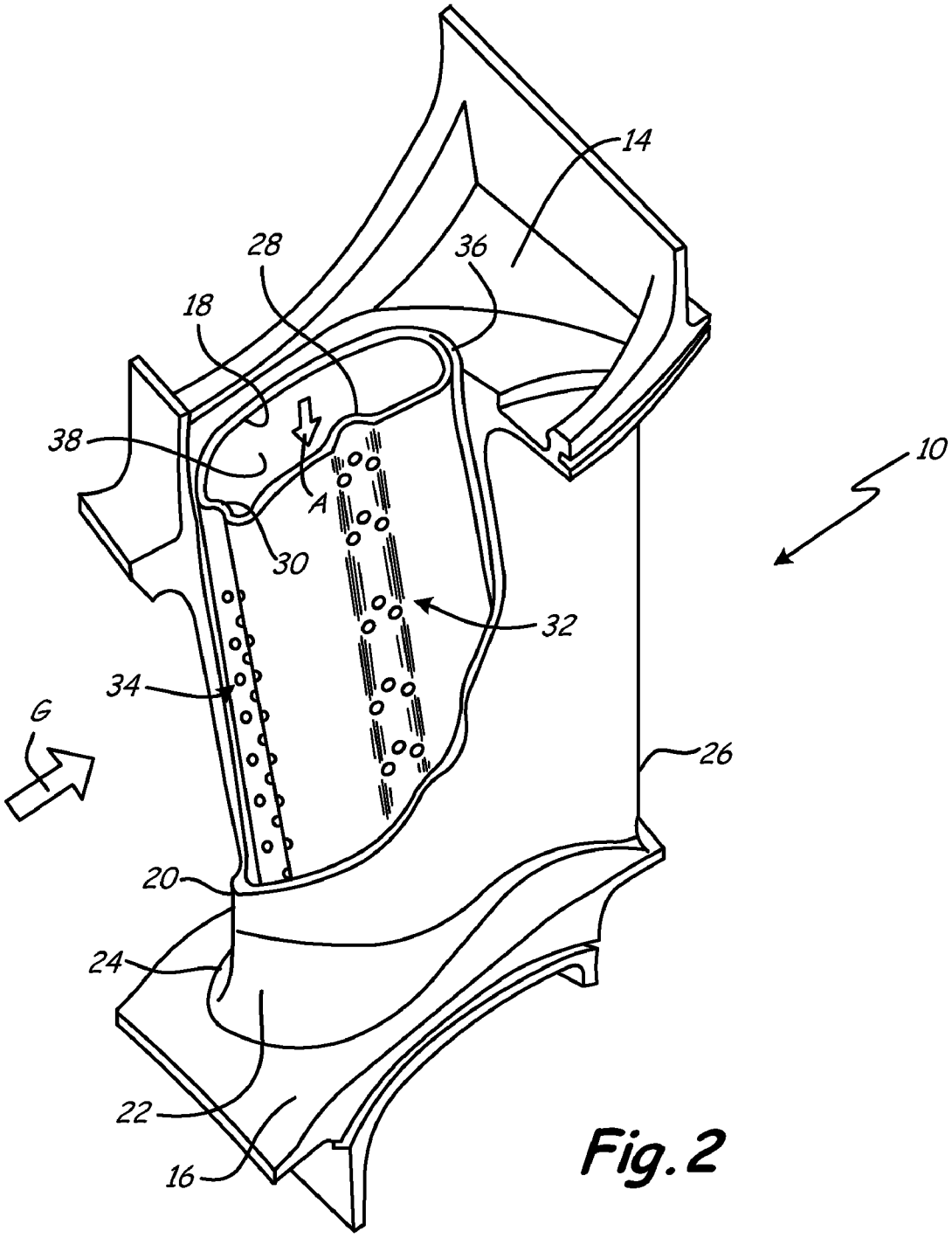
FIG. 2 is a partially broken away perspective view of the stationary turbine vane of FIG. 1 showing cooling holes positioned along the divots of the airfoil baffle.

FIG. 2 is a partially broken away perspective view of stationary turbine vane 10 of FIG. 1 showing the position of pressure side divot 28 and leading edge divot 30 of baffle 18 with respect to airfoil 12. Pressure side divot 28 and leading edge divot 30 include cooling holes 32 and cooling holes 34, respectively. Airfoil 12 comprises a thin-walled hollow structure that forms internal cavity 36 for receiving baffle 18 between shrouds 14 and 16. Baffle 18 comprises a hollow, sheet metal structure that forms cooling air supply duct 38. In the embodiment shown, outer diameter shroud 14 includes an opening to receive baffle 18, while inner diameter shroud 16 is closed to support baffle 18. Baffle 18 is typically joined, such as by welding, to either outer diameter shroud 14 or inner diameter shroud 16, while remaining free at the opposite end. The ends of baffle 18 are open to receive cooling air A for cooling airfoil 12 from temperatures produced by hot gas G. In other embodiments, however, one end of baffle 18 is closed or semi-closed to assist in forcing cooling air A out cooling holes 32 and 34. Typically, the closed or semi-closed end of baffle 18 is the end not connected to shrouds 14 and 16.

Cooling air A enters supply duct 38 of baffle 18, passes through cooling holes 32 and 34 and enters internal cavity 36 to perform impingement cooling on the interior of airfoil 12. Cooling holes 32 and 34 comprise columns of cooling holes that extend across divots 28 and 30, respectively. Divots 28 and 30 comprise elongate, longitudinal depressions within baffle 18 that extend from the outer diameter end to the inner diameter end of baffle 18. As such, cooling holes 32 and 34 are directed across the entire span of airfoil 12. In other embodiments, however, divots 28 and 30 need not extend the entire length of baffle 18. Divots 28 and 30 are contoured so as to form surfaces into which cooling holes 32 and 34 are disposed to face airfoil 12 at different angles. Specifically, cooling holes 32 comprise a series of three columns disposed along surfaces of divot 28. Likewise, cooling holes 34 comprise a series of three columns disposed along surfaces of divot 30. In other embodiments, only one or two columns of cooling holes may be used. For example, a single column could extend along the center of divot 28, or a pair of columns could extend along the sides of divot 28. Additionally, the spacing between cooling holes in each column can be varied to direct more cooling air to hotter portions of airfoil 12. The surfaces of divots 28 and 30 are shaped to deliver a concentrated volume of cooling air A to different longitudinal sections of airfoil 12. As such, divots 28 and 30 operate independently to cool a hotspot along airfoil 12 and need not be used together. Various divots can be positioned on any surface around the perimeter of baffle 18, including suction side 24.

Hot gas G flows across vane 10, impinges leading edge 20 and flows across suction side 22 and pressure side 24 of airfoil 12. The flow dynamics of gas G produced by the geometry of airfoil 12 may result in a particular portion of airfoil 12 developing a hotspot where the temperature rises to levels above where the temperature is at other places along airfoil 12. For example, the specific design of airfoil 12 may lead to hotspots based on the manner with which pressure side 22 engages gas G to perform work. Also, as with the case of all airfoil designs, leading edge 20 of airfoil 12 is particularly susceptible to hotspots due to interaction with the hottest portions of the flow of gas G. Direct impingement of gas G on leading edge 20 also inhibits the formation of turbulent flow across airfoil 12 that provides a buffer against gas G. As such, it is desirable to deliver additional cooling air A to hotspots on airfoil 12. Divot 28 is positioned on the pressure side of baffle 18 to deliver cooling air A to a hotspot along a longitudinal section of airfoil 12 at a specific chord-wise position on pressure side 22. Divot 30 is positioned on the leading edge of baffle 18 to deliver cooling air A to a hotspot along a longitudinal section of airfoil 12 at leading edge 20. The contours of divot 28 and divot 30 aim the columns of cooling holes 32 and 34, respectively, to the hotspots to reduce the temperature of airfoil 12.

Figure 3:
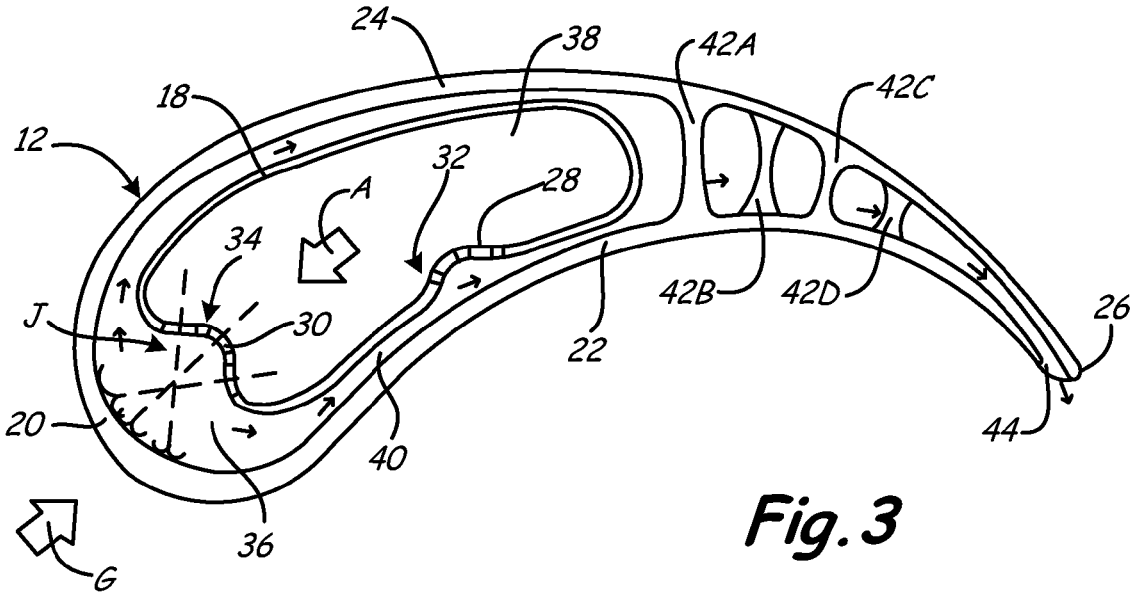
FIG. 3 is a cross-sectional view of the stationary turbine vane of FIG. 1 showing a cooling circuit between the turbine vane and the airfoil baffle for cooling air from the cooling holes.

FIG. 3 is a cross-sectional view of stationary vane 10 of FIG. 1 taken at section 3-3 showing cooling circuit 40 between airfoil 12 and baffle 18. Airfoil 12 includes leading edge 20, pressure side 22, suction side 24, trailing edge 26, pedestals 42A-42D and discharge slot 44. Baffle 18 includes pressure side divot 28, leading edge divot 30, pressure side cooling holes 32 and leading edge cooling holes 34. Baffle 18 is inserted into internal cavity 36 and is maintained at a minimum distance from airfoil 12 by standoffs (not shown). Hot gas G, such as from a combustor of a gas turbine engine, impinges leading edge 20 of airfoil 12. Pressurized cooling air A, such as relatively cooler air from a compressor of the gas turbine engine, is directed into supply duct 38 of baffle 18.

Airfoil 12 is fabricated, typically by casting, as a thin-walled structure in the shape of an airfoil. The leading edge portions of pressure side 22 and suction side 24 are displaced from each other to form internal cavity 36. In the embodiment shown, internal cavity 36 comprises a single space, but in other embodiments cavity 36 may be divided into segments using integral partitions. Internal cavity 36 continually narrows as internal cavity 36 progresses from leading edge 20 toward trailing edge 26. Pressure side 22 and suction side 24 do not touch at trailing edge 26 such that discharge slot 44 is formed. The trailing edge portions of pressure side 22 and suction side 24 are supported with pedestals 42A-42D. Pedestals 42A-42D typically comprise small-diameter cylindrical stanchions that span the distance between pressure side 22 and suction side 24. Pedestals 42A-42D are staggered so as to form an anfractuous flow path between cavity 36 and discharge slot 44.

Baffle 18 is formed into the general shape of an airfoil so as to match the shape of internal cavity 36. For example, baffle 18 includes a leading edge profile that tracks with leading edge 20. In embodiments where cavity 36 is divided with partitions, a baffle can be provided to each segment of cavity 36. In such embodiments, the profile of baffle 18 may have other configurations, such as having a flat surface to track with a partition. A plurality of divots can be positioned along any surface of a baffle to cool a plurality of unique hotspots. The perimeter of baffle 18 is continuous such that a simple hoop-shaped structure is formed. The walls of baffle 18 are shaped such that duct 38 comprises a single chamber. For example, divots 28 and 30 are not so deep as to divide duct 38 into different flow paths. The inner and outer diameter ends of baffle 18 are open such that shrouds 14 and 16 (FIG. 2) control flow of cooling air A into duct 38. Configured as such, baffle 18 is minimally shaped to facilitate easy manufacture.

Baffle 18 is typically formed from thin sheet metal. First, a pattern is cut from a piece of flat sheet metal. Next, the pattern is bent to form a rough-shaped hollow body. The ends of the hollow body are welded such that the baffle has a continuous perimeter. The shape of the hollow body is then finished using a series of die-shaping steps which give the hollow body the general shape of an airfoil. Other features, such as standoffs and divots, can be easily formed into the sheet metal using the die-shaping steps. The divots are positioned away from the welded seam such that the divots are seamless. In one embodiment, the welded seam is positioned away from the leading edge of baffle 18 such that leading edge divot 30 of baffle 18 is seamless. The top and bottom of the hollow, airfoil-shaped structure can then be trimmed to give baffle 18 the desired height for use with a specific vane. If desired, an end of baffle 18 can be closed of semi-closed by crimping and then welded shut if fully closed. Plates can then be welded to each end to facilitate connection with shrouds 14 and 16. Finally, cooling holes are produced in baffle 18 using any conventional method.

Baffle 18 is disposed within airfoil 12 such that cooling circuit 40 is formed within cavity 36. Standoffs, which may be integrally formed with baffle 18 or airfoil 12, comprise small pads that extend across circuit 40 to inhibit movement of baffle 18 within cavity 36. Cavity 36 within airfoil 12 is open to duct 38 within baffle 18 through cooling holes 32 and 34. As such, a pressure differential is produced between cavity 36 and duct 38 when cooling air A is directed into baffle 18. Cooling air A is thus pushed through cooling holes 32 and 34 into cavity 36. Cooling holes 34 shape cooling air A into a plurality of small air jets J. Similarly, jets of cooling air A enter cavity 36 through cooling holes 32, but illustration of such air jets is omitted for clarity. Baffle 18 typically also includes other cooling holes (not shown) that are distributed over the entirety of baffle 18 for cooling of portions of airfoil 12 away from divots 28 and 30. Air jets J enter cooling circuit 40 whereby the air cools the interior surface of airfoil 12. Air jets J enter cavity 36, flow around the outside of baffle 18, and are dispersed into pedestals 42A-42D. Air jets J flow above and below pedestals 42A-42D as they migrate toward discharge slot 44 where the air is released into hot gas G flowing around airfoil 12. Air jets J mix within cavity 36 near leading edge 20 to perform various modes of cooling on airfoil 12.

Figure 4:
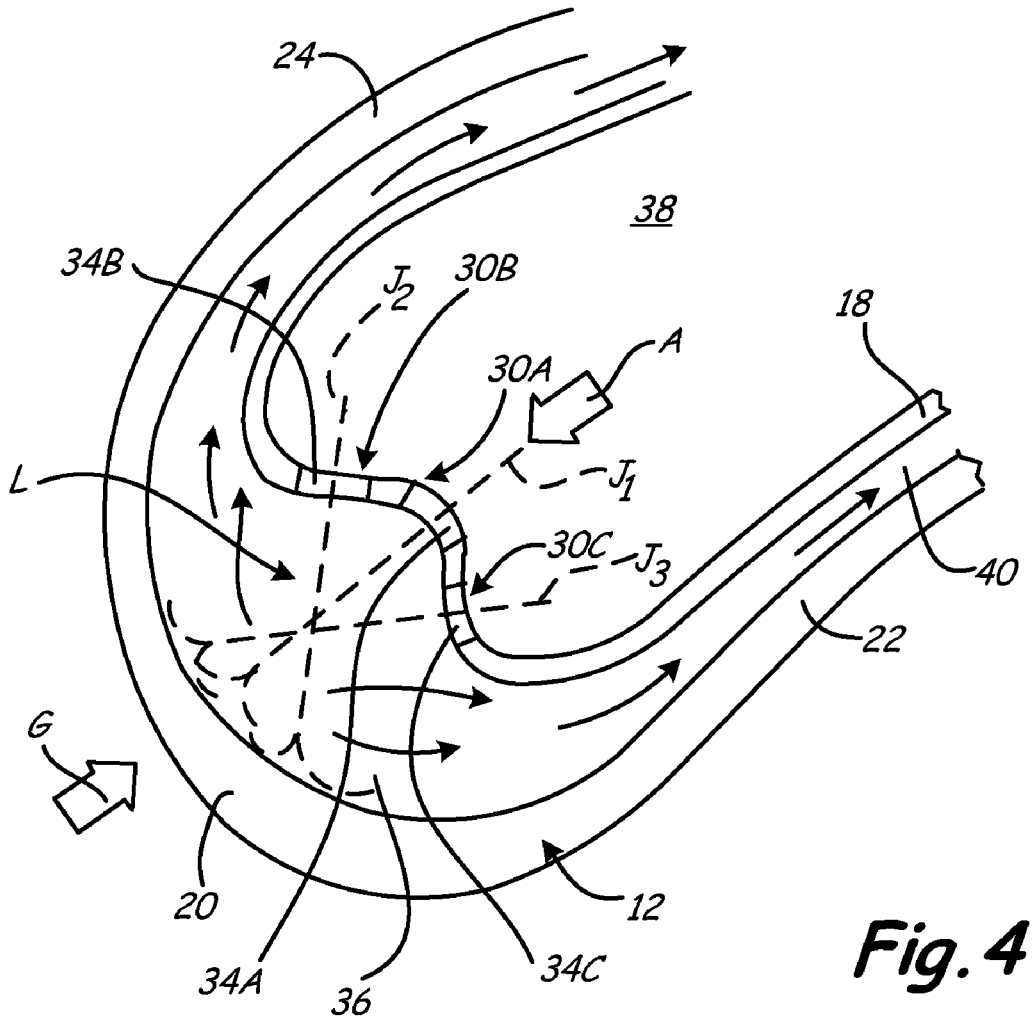
FIG. 4 is a close up view of the stationary turbine vane of FIG. 3 showing leading edge portions of the turbine vane and the airfoil baffle.

FIG. 4 is a close up view of stationary turbine vane 10 of FIG. 3 showing leading edge portions of airfoil 12 and baffle 18. Airfoil 12 includes leading edge 20, pressure side 22 and suction side 24. Baffle 18 includes divot 30, which is comprised of sections 30A-30C, and cooling holes 34, which include cooling holes 34A-34C. Baffle 18 is positioned within cavity 36 of airfoil 12 to form cooling circuit 40. Cooling air A is provided to supply duct 38 within baffle 18. Hot gas G impinges upon and heats airfoil 12. In particular, leading edge 20 of airfoil 12 comprises a hotspot having localized increases in temperature from hot gas G, as compared to other surfaces on airfoil 12. As such, divot 30 is provided along the leading edge portion of baffle 18 to focus cooling air A at leading edge 20. Cooling holes 34A-34C of divot 30 direct air jets $J_1$-$J_3$ onto airfoil 12.

Cooling holes are typically drilled, or otherwise produced, to extend perpendicularly through the walls of airfoil cooling baffles. As such, jets of cooling air typically radiate from the baffle at trajectories normal to the baffle surface. The walls of baffles are typically thin such that it is difficult to alter the trajectory of air passing through cooling holes extending through the baffle. For example, the thickness of baffle 18 is on the order of tens of thousandths of an inch (less than a millimeter) thick. As such, an angled hole through a baffle produces little if any change in the trajectory of air traveling though the hole. Angled cooling holes thus perform substantially similarly to perpendicular cooling holes in thin baffles. It is, however, desirable to use thin-walled baffles due to their light weight, inexpensiveness, and manufacturability. Furthermore, the tolerances required of baffles prohibit casting of thick, heavier weight structures into which effective angled cooling holes could be machined. Divots of the present invention permit angling of cooling holes jets $J_1$-$J_3$ in thin-walled baffles.

Cooling holes 34A-34C are disposed along baffle 18 at positions equidistant from either the inner diameter end or the outer diameter end of baffle 18 such that jets $J_1$-$J_3$ are located in a common plane. Jets $J_1$-$J_3$ will impact airfoil 12 at the same radial position along vane 10. Cooling holes 34 are thus disposed in a plurality of parallel columns and rows, as shown in FIG. 2. However, the cooling holes could be staggered so as to form columns with offset rows. Cooling holes 34A-34C are sized such that stagnation of cooling air A within duct 38 is prevented. For example, cooling holes 34A-34C are sized to maintain the pressure within duct 38 above that of cavity 36 such that metering of air A through holes 34A-34C is maintained. In one embodiment, cooling holes 34A-34C are approximately equal in size to each other. However, cooling holes along other longitudinal positions of baffle 18 may be larger or smaller than cooling holes 34A-34C. For example, large cooling holes may be used near hotspots, while smaller cooling holes may be used at cooler positions along airfoil 12. Thus, cooling holes 34, as well as cooling holes 32 (FIG. 2) and other cooling holes within baffle 18 do not produce a large pressure drop across baffle 18.

Walls 30A-30C of divot 30 are curved to focus jets $J_1$-$J_3$ at common location L to promote advanced cooling modes. Jets $J_2$ and $J_3$ are directed out of baffle 18 at angles oblique to the profile of baffle 18 and oblique to the interior surface of airfoil 12. Jet $J_1$ is directed out of baffle 18 normal the profile of baffle 18 and the interior surface of airfoil 12 to intersect jets $J_2$ and $J_3$ at common location L. In the configuration shown, location L is positioned approximately midway between baffle 18 and airfoil 12. In other embodiments, location L is positioned on the surface of airfoil 12 or outside of airfoil 12. In all embodiments, however, jets $J_1$-$J_3$ impact airfoil 12 at a common location that has a smaller width as compared to cooling holes that would be disposed along a baffle not having divot 30 along the leading edge. Thus, a greater volume of cooling air is concentrated at or near leading edge 20. Angling of cooling holes 34A-34C towards each other also promotes entrainment and mixing of jets $J_1$-$J_3$ as the jets travel toward leading edge 20 of airfoil 12. Entrainment of jets $J_1$-$J_3$ forms turbulence that increases the cooling effect on airfoil 12. Thus, both impingement cooling and conductive cooling is enhanced at leading edge 20 to remove heat from airfoil 12. In other embodiments, cooling of airfoil 12 can be further enhanced by providing turbulators along the interior surface of airfoil 12. Conductive cooling is continuously provided as jets $J_1$-$J_3$ continue through cooling circuit 40 to discharge slot 44 (FIG. 3). As such, divots of the present invention permit aiming of cooling holes in thin-walled and easy to manufacture baffles to enhance cooling of airfoils at hotspots.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A baffle insert for an internally cooled airfoil, the baffle insert comprising:

a liner having a continuous perimeter formed to shape a hollow body having a first end and a second end;

a divoted segment of the hollow body positioned between the first end and the second end; and a plurality of cooling holes positioned on the divoted segment to aim cooling air exiting the baffle insert;

wherein the divoted segment comprises an elongate, longitudinal depression in the hollow body extending between the first end and the second end, the depression comprising:

a first curved segment having a first column of cooling holes;

a second curved segment having a second column of cooling holes; and an elbow segment connecting the first curved segment with the second curved segment and having a third column of cooling holes centered on the divoted segment.

2. The baffle insert of claim 1 wherein the elbow is disposed along a leading edge of the hollow body.

3. The baffle insert of claim 1 wherein the first and second columns of cooling holes extend approximately perpendicularly through the curved segments of the depression so as to discharge cooling air at an oblique angle with respect to a profile of the liner.

4. The baffle insert of claim 3 wherein the cooling holes of the first column, the second column and the third column are approximately equally sized and disposed in parallel rows.

5. The baffle insert of claim 3 wherein the first and second curved segments and the elbow segment are disposed about an arc to focus cooling air at a common location to promote mixing of the cooling air.

6. The baffle insert of claim 3 wherein the third column of cooling holes extends approximately perpendicularly through the elbow segment of the depression so as to discharge cooling air normal with respect to a profile of the liner.

7. The baffle insert of claim 1 wherein at least one of the first and second ends of the continuous perimeter of the hollow body are open and walls of the hollow body are not touching such that a single, continuous cooling passage is formed within the baffle insert.

8. The baffle insert of claim 1 and further comprising a plurality of divoted segments each shaped to focus cooling air at different common locations.

9. The baffle insert of claim 1 wherein the divoted segment comprises a seamless portion of the hollow liner body.

10. The baffle insert of claim 1 wherein the liner is formed of sheet metal.

11. An internally cooled airfoil comprising:

an outer airfoil body shaped to form a leading edge, a trailing edge, a pressure side and a suction side surrounding an internal cooling channel; and a baffle insert disposed within the internal cooling channel, the baffle insert comprising:

a continuous inner liner body having a perimeter shaped to correspond to the shape of the internal cooling channel and to form a cooling air supply duct;

a divot disposed along the inner liner body; and a plurality of cooling holes positioned on the divot to aim cooling air from the supply duct onto the outer airfoil body at a common location;

wherein the divot comprises:

a first leg including a first column of cooling holes configured to direct cooling air at an oblique angle to the internal cooling channel;

a second leg including a second column of cooling holes configured to direct cooling air at an oblique angle to the internal cooling channel; and an elbow connecting the first leg with the second leg, the elbow including a third column of cooling holes configured to direct cooling air normal to the internal cooling channel.

12. The internally cooled airfoil of claim 11 wherein the continuous inner liner body forms a single air supply duct within the baffle insert.

13. The internally cooled airfoil of claim 12 wherein the baffle insert is displaced from the outer airfoil body along the entire continuous inner liner body such that a cooling circuit is formed between the outer airfoil body and the baffle insert.

14. The internally cooled airfoil of claim 11 wherein the common location comprises a hotspot on the outer airfoil body.

15. The internally cooled airfoil of claim 11 wherein the outer airfoil body comprises a stationary vane comprising:

an inner diameter vane shroud; and an outer diameter vane shroud;

wherein the baffle insert is supported within the internal cooling channel by the inner diameter vane shroud and the outer diameter vane shroud.

16. The internally cooled airfoil of claim 11 wherein the third column of cooling holes is centered on the divot.

17. A baffle for providing impingement cooling to an interior of an airfoil, the baffle comprising: a plurality of equally sized cooling holes disposed along a continuous contour in the baffle such that cooling air emanating from the cooling holes is entrained before impacting the airfoil, wherein the baffle is comprised of sheet metal, wherein the contour comprises an elbow segment connecting a first curved segment with a second curved segment and having a central column of cooling holes, wherein the central column of cooling holes is centered on the continuous contour in the baffle.

18. The baffle of claim 17 wherein the contour comprises:

the first curved segment having a first column of cooling holes; the second curved segment having a second column of cooling holes.

19. The baffle of claim 18 wherein the elbow segment is positioned at a seamless leading edge portion of the baffle.

20. The baffle of claim 19 wherein the baffle is open at inner and outer diameter ends to form a hoop-like structure approximating a shape of an airfoil.

* * * * *